United States Patent [19]

Nakamura et al.

[11] Patent Number: 4,775,437

[45] Date of Patent: Oct. 4, 1988

[54] PROCESS OF FORMING CYLINDER WALL OF BURNING CYLINDER FOR USE IN HEATING APPARATUS

[75] Inventors: Kazuharu Nakamura, Nagoya; Yoshio Mito, Gifu; Yukihiro Oguchi, Toyoake, all of Japan

[73] Assignee: Toyotomi Kogyo Co., Ltd., Aichi, Japan

[21] Appl. No.: 759,141

[22] Filed: Jul. 26, 1985

[51] Int. Cl.[4] ..... B44C 1/165; B05D 1/36; B05D 5/06; B05D 7/22

[52] U.S. Cl. ..... 156/237; 156/230; 427/210; 427/237; 427/255; 427/269; 431/126

[58] Field of Search ..... 427/237, 269, 287, 148, 427/210, 255; 428/204; 156/230, 237; 431/126

[56] References Cited

U.S. PATENT DOCUMENTS

| | | | |
|---|---|---|---|
| 1,251,577 | 1/1918 | Reizenstein | 427/210 |
| 3,096,184 | 7/1963 | Gallup | 427/287 X |
| 4,117,182 | 9/1978 | Andrews | 427/148 X |
| 4,462,789 | 7/1984 | Nakamura | 431/126 |

OTHER PUBLICATIONS

Kosloff, A., *Ceramic Screen Printing,* second edition, Cincinnati, Ohio, The Signs of The Times Publishing Company, 1977, pp. 118–119.

Tweney, C. F. and Hughes, L. E. C., ed., *Chambers's Technical Dictionary,* third edition, New York, The MacMillan Company, 1965, p. 294.

*Primary Examiner*—Evan Lawrence

*Attorney, Agent, or Firm*—Koda and Androlia

[57] ABSTRACT

A process of forming a cylinder wall of a burning cylinder for use in a heating apparatus which comprises forming an enamel pattern on the surface of a base made of a transparent or translucent and highly heat resistant material; forming thereon a metal or metallic compound layer that is 0.1 to 0.5μ in thickness and high in transparency; and thereafter heating the same as a whole to enamel the pattern and the layer.

7 Claims, 1 Drawing Sheet

PROCESS OF FORMING CYLINDER WALL OF BURNING CYLINDER FOR USE IN HEATING APPARATUS

BACKGROUND OF THE INVENTION

This invention relates to a process of forming a cylinder wall of a burning cylinder for use in heating apparatuses utilizing flame which is accompanied by generation of heat and luminescence, e.g., oil stove and gas stove, or heating apparatuses utilizing a red-hot material which is accompanied by generation of heat and luminescence, e.g., electric stove.

Kazuhara Nakamura, one of the applicants of this application, filed U.S. application Ser. No. 324,869 entitled "Burning cylinder for use in heating apparatuses" on Nov. 25, 1981, now U.S. Pat. No. 4,462,789. The burning cylinder disclosed therein is disposed to surround a source of heat and forms a shell of a burning chamber, and its cylinder wall is formed by coating the inner and/or outer surface of a base made of a material that is transparent or translucent and high in heat-resistivity with a metal layer that is about 0.1–0.5$\mu$-thick and high in transparency. In the burning cylinder with the thus formed cylindrical wall, when a source of heat emits light, said source can be seen from the outside together with the plurality of different color images, which is already well known as the prior art.

However, the thus obtained burning cylinder is defective in that when the source of heat emits light by burning or the like, the burning cylinder gives a person a feeling of beauty as described above, but otherwise, as its outward form is not especially unique, there is no possibility of a viewer's interest being aroused especially by seeing it, in other words there is no possibility of a looker having a feeling different from that obtained when looking at another burning cylinder.

SUMMARY OF THE INVENTION

It is an object of this invention to improve said conventional processes of forming cylindrical walls of burning cylinders by eliminating inherent drawbacks in those processes, and to provide a burning cylinder that is capable of presenting a beautiful sight irrespective of the time when the source of heat emits light or not and arousing viewer's striking interest.

It is another object of this invention to provide a process of forming a burning cylinder wall, wherein a pattern of characters, figures and the like, which appeal to a viewer's sense of sight when a source of heat does not emit light, can be readily formed on the surface of the burning cylinder wall, and further said pattern does not change even when subjected to heat generated by emittance of light from a source of heat and is kept stable for a long period of time.

According to this invention, said object can be achieved by forming a base of the cylindrical wall of the burning cylinder using a material that is transparent or translucent and high in heat-resistivity; applying said pattern on the inner and/or outer surface of the base; forming, on said surface, a thin layer of a metal or a metal compound that is about 0.1–0.5$\mu$-thick and high in transparency; thereafter heating the same as a whole and enameling it. That is, the pattern formed on the surface of the base can be perceived from the outside directly or indirectly through a layer of high transparency at both times when a source of heat emits light and does not emit light, whereby a viewer's attention is attracted thereto. Furthermore, since said layer is made of a metal or a metal compound and after its application on the base surface, the same is wholly heated, both the layer and the pattern are coated on the base surface at the same time, and the pattern comes to have high heat resistance and durability as the normal patterns formed on ceramics do.

In the illustrated, explanatory embodiments of this invention, a base is made of glass or ceramics, in the case of a metal layer, Ti, Zr, Zn or Sb or a mixture of Ti, Zr, Zn and Sb is coated on the base by heat evaporation within a high temperature atmosphere or in the case of metal compound layer, a metallic salt compound solution is coated on the base by spraying said solution on the base or by dipping the base in the solution and then taking it up from the solution; and printing is effected by a transfer method using a pattern-printed transfer paper, the method of printing the pattern with transfer ink by means of a pattern-printing cylinder, or the like, whereby the above mentioned cylinder wall of the burning cylinder can generally be obtained very easily as well as cheaply.

The objects and characteristics described above and other characteristics will be self-explanatory when referred to the two embodiments illustrated by the appended drawings.

DETAILED DESCRIPTION OF THE INVENTION

Figure 1:
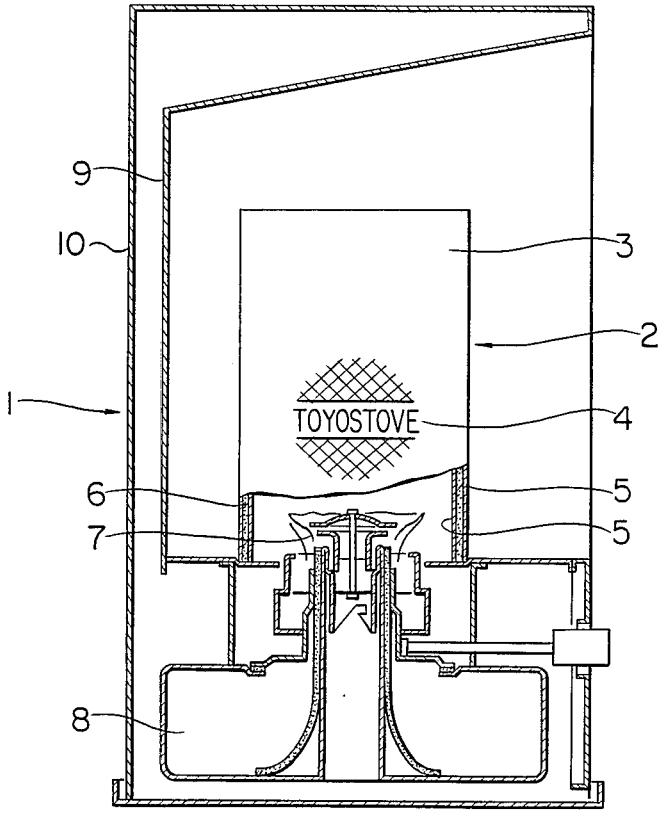
FIG. 1 is a partly cutaway front view of an oil stove equipped with a burning cylinder that has wholly been made-up of the cylinder wall according to this invention.

In FIG. 1, reference numeral 2 denotes a burning cylinder of an oil stove 1, said burning cylinder being disposed above a burning device 7 so as to form a burning chamber. Fuel is supplied from a fuel tank 8 to the burning device. A reflector 9 is disposed leaving a fixed distance against the outer periphery of the burning cylinder 2. This reflector 9 is attached to a frame 10.

Reference numeral 3 denotes a cylinder wall constituting the entire burning cylinder 2. This cylinder wall 3 is formed of a transparent or translucent and high heat resistant material, and a pattern is printed thereon according to the transfer method which comprises transferring a pattern at desired places on the inside and/or outside surface of the cylinder wall by using a pattern-printed decalcomania paper such as paper, cellophane or the like. Then, this base 6 is dried.

Next, on each of the inside and outside surfaces of the base 6 is formed a highly transparent layer 5 that is about 0.1 to 0.5$\mu$ in thickness and comprised of a metal or metallic compound. This layer 5 may be formed only on the inside surface or outside surface. This layer 5 is, as disclosed also in the aforesaid U.S. Pat. No. 4,462,789 is formed by heat evaporating Ti, Zr, Zn, Sb or the like under high temperature vacuum in the case where said layer 5 is a metal layer; by spray-depositing a solution obtained by dissolving a metallic salt compound with water or an organic solvent in the case where said layer is a metallic compound layer; and further by dipping the base 6 in the above mentioned solution and then taking it out of the solution.

When the layer 5 has been formed as aforesaid the cylinder wall is wholly placed in a kiln for enameling by heating the pattern 4 and the coating layer 5, thereby obtaining the cylinder wall as intended previously.

Figure 2:
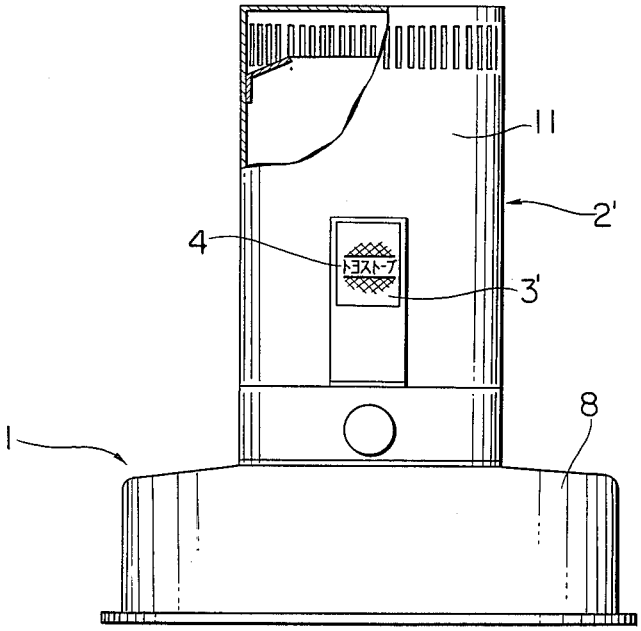
FIG. 2 is a partly cutaway front view of an oil stove of a type different from the aforesaid one, the cylinder wall of said oil stove being partly made-up of the cylinder wall according to this invention.

In the case of an oil stove illustrated in FIG. 2, a cylinder wall 3' according to this invention constitutes part of a burning cylinder 2'.

Another portion 11 occupying the greater part of the burning cylinder 2' is formed of a normal steel or the like. The cylinder 3' is built-up in the exactly same manner as the cylinder wall 3, and then is attached to a window portion formed on the other portion 11.

From thus formed cylinder walls 3, 3', as in said conventional burning cylinders, a source of heat, when emitting light, can be looked at together with plural different color images to give a person a feeling of beauty, and further the pattern can be seen as overlapping them to give a person a stronger feeling of beauty. Especially when the pattern is located below, the source of heat which emits glittering light is sheltered by the pattern so that it is invisible directly to a looker. When a source of heat does not emit light, the source of heat and the image of the source of heat become impossible to see, but the pattern remains visible and attracts a viewer's interest. Moreover, the pattern is high in heat resistance and durability so that there is no possibility of the pattern getting out of shape because said pattern is coated on the base together with the layer.

Still further, the process according to this invention is relatively easy to operate, and therefore the cylinder wall as aforesaid can be provided cheaply.

Although a particular preferred embodiment of the invention has been disclosed in detail for illustrative purposes, it will be recognized that variations or modifications of the disclosed apparatus, including the rearrangement of parts, lie within the scope of the present invention.

What is claimed:

1. A process of forming a cylinder wall of a burning cylinder for use in a heating apparatus, said cylinder wall being disposed surrounding a source of heat so as to constitute an outer shell of a burning chamber, wherein a base of the cylinder wall is formed of transparent or translucent and highly heat resistant material, said processing comprising the ordered steps of applying an enamel pattern comprising characters, figures and the like on the inside and/or outside surface of the base; forming on the inside and/or outside surface of the base a transparent coating layer which is about 0.1 to 0.5$\mu$ in thickness from a solution which comprises a metal or metallic compound dissolved in a solvent; and thereafter heating the same for enameling said pattern and said coating layer, said coating layer remaining transparent.

2. A forming process according to claim 1 wherein said base is formed of glass or ceramics.

3. A forming process according to claim 1 wherein formation of said pattern is carried out by the transfer method using a pattern-printed decalcomania paper.

4. A forming process according to claim 1 wherein said layer of metal consists of Ti, Zr, Zn, Sb or mixtures thereof.

5. A forming process according to claim 1 wherein said coating layer is formed by spraying depositing, on the base, said solution.

6. A forming process according to claim 1 wherein said cylinder wall comprises at least a part of the burning cylinder.

7. A forming process according to claim 1 wherein said coating layer comprising a metallic compound is formed by dipping said base in said solution.

* * * * *